United States Patent [19]

Chewning, Jr. et al.

[11] Patent Number: 4,469,393

[45] Date of Patent: Sep. 4, 1984

[54] MODULAR CONNECTOR

[75] Inventors: Marshall T. Chewning, Jr., Jarrettsville; Thomas P. Borgoyn, Randallstown, both of Md.

[73] Assignee: Westinghouse Electric Corp., Pittsburgh, Pa.

[21] Appl. No.: 308,319

[22] Filed: Oct. 2, 1981

[51] Int. Cl.[3] ..... H01R 9/24

[52] U.S. Cl. ..... 339/198 GA; 339/91 R

[58] Field of Search ..... 339/198 GA, 198 R, 198 H, 339/75 M, 91 R, 49 R, 63 R, 63 M, 196 R, 196 S, 206 P

[56] References Cited

U.S. PATENT DOCUMENTS

| | | | |
|---|---|---|---|
| 3,259,870 | 7/1966 | Winkler | 339/198 G |
| 3,825,874 | 7/1974 | Peverill | 339/143 R |
| 3,848,951 | 11/1974 | Michaels et al. | 339/91 R |
| 3,993,395 | 11/1976 | Taylor | 339/198 H |
| 4,005,925 | 2/1977 | Sudre | 339/198 H |

*Primary Examiner*—Eugene F. Desmond
*Assistant Examiner*—David L. Pirlot
*Attorney, Agent, or Firm*—J. B. Hinson

[57] ABSTRACT

The invention comprises an electrical connector composed of a plurality of individually replaceable modules. Each of the modules includes a central portion where either male or female type connector pins can be mounted. The edges of the modules includes locking means permitting each of the modules to be secured to an adjacent module. Each of the modules may have different types of connector pins. This structure permits a connector of any desired size or pin configuration to be conveniently assembled from individual modules.

6 Claims, 4 Drawing Figures

MODULAR CONNECTOR

BACKGROUND OF THE INVENTION

1. Field of the Invention

The invention relates to connectors and more specifically to an electrical connector comprising a plurality of modules which can be conveniently assembled to form a connector having the desired number and configuration of pins.

2. Description of the Prior Art

Typically prior art connectors provided a fixed number of pins in a specific configuration. Modular connectors are also available, however, they generally required a mounting frame with a specific mounting frame limiting the number of modules to no more than a specified number. A specific connector was also limited to a specific type of connector pin. For example, coaxial connector pins could not be intermixed with conventional connector pins.

SUMMARY OF THE INVENTION

The connector which is the subject of this invention comprises a plurality of modules. Each of the modules contains a locking mechanism permitting the module to be conveniently secured to an adjacent module. The modules can be secured edge-to-edge and top-to-top permitting the connector to be expanded in both dimensions by selectively adding modules. Additionally, selected module locations within a connector can be used to provide affixing means permitting the connector to be secured a panel or the male and female portions of the connector secured together.

DESCRIPTION OF THE PREFERRED EMBODIMENT

Figure 1:
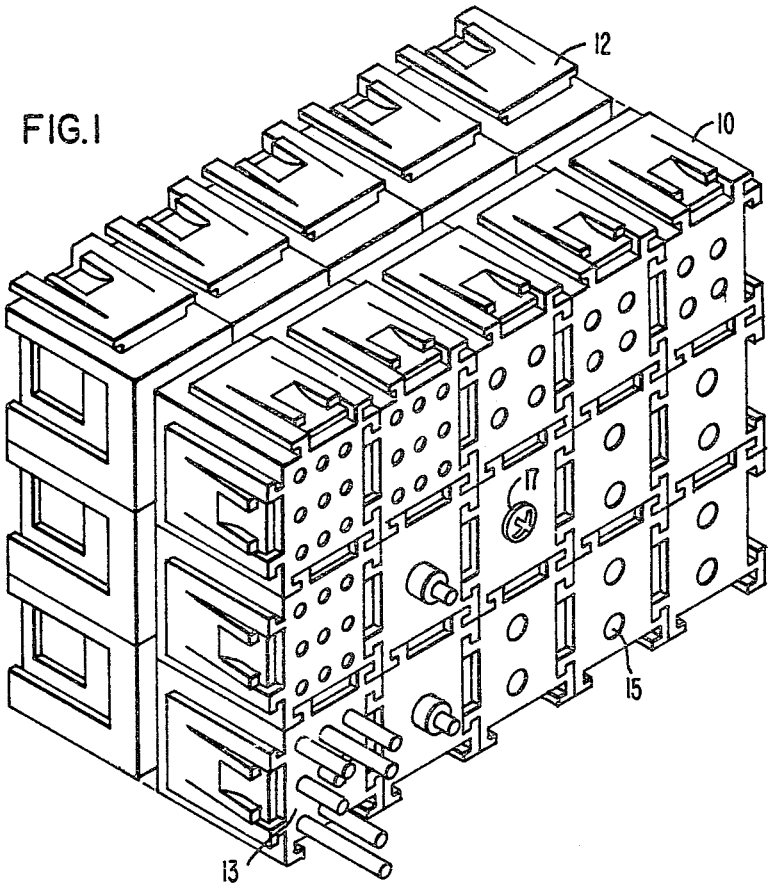
FIG. 1 is a somewhat isometric diagram of the connector comprising male and female portions of a connector comprising the invention.

The preferred embodiment of the invention is illustrated in FIG. 1. As is conventional the basic connector comprises a male portion 10 and a female portion 12. Both the male and female portions 10 and 12 are constructed using substantially identical modules with the exception that the male and female pins may be secured to the modules utilizing different latching mechanisms. For purposes of convenience the first connector 10 will be designated as the male portion of the connector while portion 12 is designated the female section.

Figure 2:
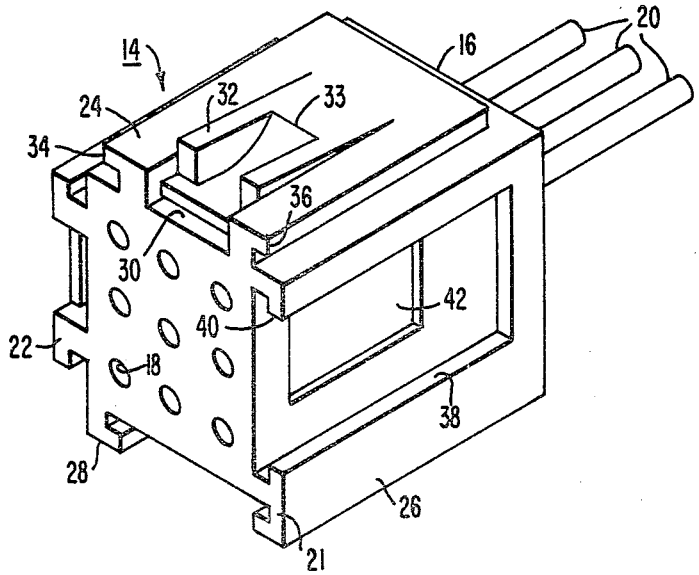
FIG. 2 is an isometric drawing of one module of the connector illustrated in FIG. 1.

One of the modules of the male connector 10 is illustrated in more detail at reference numeral 14 in FIG. 2. The module 14 includes a back surface having therein a series of openings with a typical opening illustrated at reference numeral 18. Three typical male pins collectively illustrated at reference numeral 20 extend through the front surface of the module 14. Any suitable technique, including prior art techniques, may be used to secure the pins 20 in the module as well as to attach electrical conductors to these pins.

Module 14 also includes four sides 22, 24, 26 and 28. Sides 22 and 24 are identical except for orientation. Similarly, sides 26 and 28 are also identical except for orientation. For this reason, only the sides 24 and 26 will be described in detail.

The top surface 24 of the module 14 includes a first channel 30 which has two outwardly extending edge portions 34 and 36. Positioned in the channel 30 is a resilient tab 32 oriented such that the top surface of the tab 32 extends slightly about the surface 24 at its unattached end with the upper surface of the tap 32 receding to be level with the surface 24 near the point where it is attached to the module 14. Removing a particular module from an assembled connector is simplified, as subsequently discussed, by ramp shaped channel 33 near the central portion of resilient tab 32. A thin flat member can be slid up the ramp shaped channel 33 thereby depressing the resilient tab 32. The outwardly extending channel edges 34 and 36 extend toward the front surface 16 but terminate before they reach the front surface of the module 14.

Surface 26 includes a channel having two inward extending edges 38 and 40. The central portion of the channel formed by the inwardly extended edges 38 and 40 includes a recess 42 near the center. Inwardly extending edges 38 and 40 terminate prior to reaching the front surface 16 of the module 14.

The dimensions of the outwardly extending edges 34 and 36 are dimensioned such that the outwardly extending edges 34 and 36 of an adjacent module will slide into the channel formed by the inwardly extending channel edges 38 and 40. Resilient tab 32 of the adjacent module will be depressed to be level with the upper surface 24 as the mating channels are slid together and expand to extend into the recess 42 when the back surfaces of adjacent modules are substantially even. This provides a locking mechanism for affixing adjacent modules together to form a connector having the desired number of pins in the desired configuration.

By utilizing the channel members on all four sides of the module, the modules can be affixed into a rectangular matrix as illustrated in FIG. 1 using any desired number of columns and rows. Modules can be removed from the assembled connector by depressing the resilient tab member 32 by sliding a thin flat object such as a small screwdriver blade up the ramp-like portion 33 to depress the resilient tab 32.

Selected modules of the connector 10 can be used for different types of connector pins. For example, the module 13 is illustrated as being used for connector pins for conventional insulated wire. Modules 15 and 19 illustrate the use of the basic module with coaxial cable. Additionally module 17 has no electrical connectors but includes an opening near its center for a screw permitting the connector 10 to be secured to connector 12 or to a panel. Of course, using a module such as module 17, having an opening therein for a fastener to secure the two portions of the connector together, requires similar provisions to be made in each portion of the connector. Although not illustrated, male and female connector pins can be intermixed within a module. The remainder of the modules illustrate that each of the modules may have a different number and size conductors.

Figure 3:
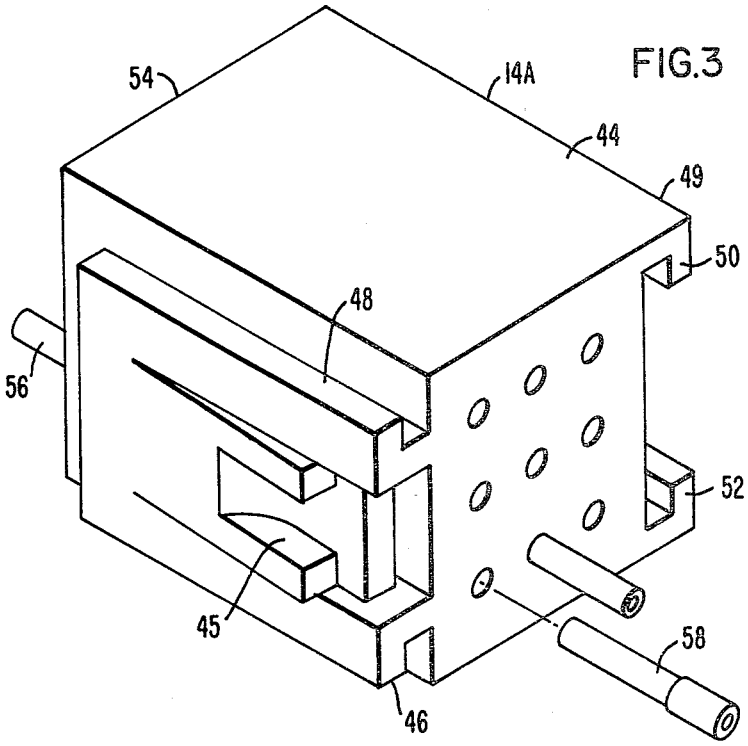
FIG. 3 is a drawing of a second embodiment of the basic module.

FIG. 3 shows a modified version, module 14A, of the module 14 illustrated in FIG. 2. Module 14A can be utilized when the connector is to be limited to one row.

Fundamentally the modification consists of removing the channels from the top and bottom surfaces of the module 14. For example the modified module 14A includes first and second extending edge members 46 and 48 on the first side surface. This surface also includes a resilient tab member 45 of the type previously discussed with reference to FIG. 2. A second side surface 49 includes two inwardly extending edges 50 and 52. The bottom portion of the channel formed by edges 58 and 52 includes a recess identical to the recess illustrated at reference numeral 42 of FIG. 2. This recess is not visible in FIG. 3. Extending edges 46 and 48 fit inside the inwardly extending edges 50 and 52 of adjacent modules permitting adjacent modules to be affixed to each other as previously described. Back surface 54 includes openings through which the pins and wires are inserted and secured using conventional techniques. A typical male pin 56 is shown extending from the back surface 54 and a typical lead 58 extending from the front surface.

Figure 4:
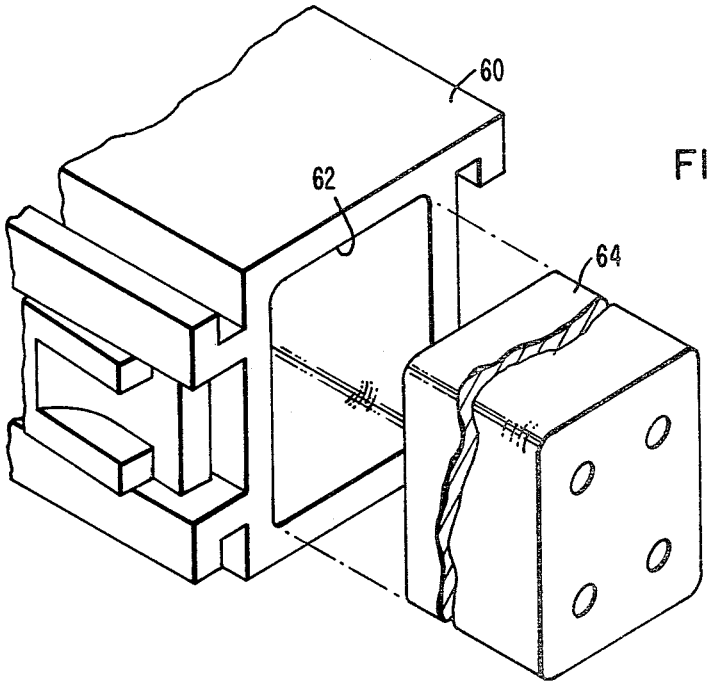
FIG. 4 is a diagram illustrating a modification of the module which permits the pin configuration of an individual module to be changed.

FIG. 4 illustrates another modification of the basic module. The modified module includes an outer shell member 60 which includes all the channel locking mechanisms previously described with reference to FIG. 1 and FIG. 2. The shell member 60 includes an opening 62 near the center. Positioned in opening 62 is an insert 64 in which either male or female connector pins can be mounted. Insert 64 is held in the shell member 62 using any convenient means. This arrangement permits pin types to be changed, for example, near the center of the connector without the inconvenience of removing the complete module.

We claim:

1. An electrical connector comprising a plurality of interlocking modules each having:

(a) electrical contact means for mating with complementary electrical contact means of another module such that electrical contact is established;

(b) a first surface including a first channel for mating with a complementary channel of another module, said first channel including first and second edge portions extending outwardly substantially parallel to said first surface and a cantilevered resilient locking tab disposed between said first and second edge portions with the free end of said cantilevered resilient locking tab extending above the fixed end of said cantilevered resilient locking tab, said resilient locking tab extending at an acute angle to said first surface;

(c) a second complementary channel member, including a recess, for mating with said first channel member of an adjacent module such that said cantilevered resilient locking tab is depressed beginning near said fixed end as said first and second channel members are slidably mated to a point where said cantilevered resilient locking tab is substantially parallel to said first surface, and thereafter extends into said recess in said adjacent module when said first and second channels are in the mated position thereby securing adjacent modules together.

2. An electrical connector comprising a plurality of interlocking modules each having:

(a) electrical contact means for mating with complementary electrical contact means of another module such that electrical contact is established therebetween;

(b) first and second surfaces disposed at ninety degrees with respect to each other, each including a channel having outwardly extending edges and a cantilevered resilient locking tab member disposed in said channel such that the free end of said cantilevered resilient locking tab normally extends above the fixed end of said cantilevered resilient locking tab and third and fourth surfaces disposed at ninety degrees with respect to each other and each of said third and fourth surfaces having a channel including inwardly extending edges and a recess disposed in the bottom portion of said channel such that by slidably mating a channel having outwardly extending edges of a first module with a channel having inwardly extending edges of a second module, said cantilevered resilient locking tab extending at an acute angle to at least one of said first or second surfaces associated with said module is progressively depressed as said channels are slidably mated beginning near said fixed end to a point where said cantilevered resilient locking tab is substantially parallel to at least one of said first or second surfaces and thereafter extends into said recess when said channels are in a mated position, whereby:

(c) said inwardly and outwardly extending edges are complementary permitting said modules to be assembled to form a matrix comprising a selected number of rows and columns.

3. An electrical connector in accordance with claim 2 wherein each of said cantilevered resilient locking tab includes a ramp-like central portion permitting said cantilevered resilient locking tab to be depressed to remove a selected module from said connector by sliding a thin flat member up said ramp-like portion.

4. An electrical connector in accordance with claim 3 wherein each of said modules includes means for mounting male and female connector pins.

5. An electrical connector in accordance with claim 3 wherein selected modules of said connector include coaxial connector means.

6. An electrical connector in accordance with claim 3 wherein selected ones of said modules includes an outer shell member and an insert permitting the connector pin configuration to be changed by changing said insert.

* * * * *